US006578490B1

(12) United States Patent
Francisco

(10) Patent No.: US 6,578,490 B1
(45) Date of Patent: Jun. 17, 2003

(54) IGNITOR APPARATUS

(76) Inventor: Bradley Jay Francisco, 1945 Matapeake Ct., St. Leonard, MD (US) 20685

( * ) Notice: Subject to any disclaimer, the term of this patent is extended or adjusted under 35 U.S.C. 154(b) by 0 days.

(21) Appl. No.: 10/179,375

(22) Filed: Jun. 26, 2002

Related U.S. Application Data

(63) Continuation of application No. 09/678,302, filed on Oct. 3, 2000, now abandoned.

(51) Int. Cl.[7] ..... C06C 5/06
(52) U.S. Cl. ..... 102/275.11; 102/275.8
(58) Field of Search ..... 102/275.11, 275.6, 102/275.8, 202.5, 202.13

(56) References Cited

U.S. PATENT DOCUMENTS 3,159,103 A * 12/1964 Bagley ..... 102/202.7
3,981,240 A * 9/1976 Gladden ..... 102/202.4
4,727,808 A * 3/1988 Wang et al. ..... 102/202.5
4,817,530 A * 4/1989 Florin ..... 102/322
5,182,417 A * 1/1993 Rontey et al. ..... 102/204
5,293,821 A * 3/1994 True et al. ..... 102/275.6
5,365,851 A * 11/1994 Shaw ..... 102/275.6
5,392,713 A * 2/1995 Brown et al. ..... 102/322
5,396,951 A * 3/1995 Ross ..... 166/63
5,631,440 A * 5/1997 Thureson et al. ..... 102/275.7
5,665,276 A * 9/1997 Kirby et al. ..... 264/3.1
5,945,627 A * 8/1999 Arpin et al. ..... 102/202.11
6,227,116 B1 * 5/2001 Dumenko ..... 102/275.3

* cited by examiner

*Primary Examiner*—Michael J. Carone
*Assistant Examiner*—M. Thomson
(74) *Attorney, Agent, or Firm*—Mark Homer

(57) ABSTRACT

An ignitor for setting off an incendiary device. The ignitor includes a container into one end of which is placed a charge of thermite. A shock tube is inserted into the other end of the container and when initiated, sends a shock wave into the container to cause ignition of the thermite. In order to prevent accidental ignition from an electrical charge, in a preferred embodiment an electrically conducting filler material surrounds the shock tube within the container, which preferably is crimped around the filler material.

11 Claims, 3 Drawing Sheets

IGNITOR APPARATUS

This application is a Continuation of application Ser. No. 09/678,302 filed Oct. 3, 2000 now abandoned.

STATEMENT OF GOVERNMENT INTEREST

The invention described herein may be manufactured and used by or for the Government of the United States of America for government purposes without the payment of any royalties therefor.

BACKGROUND OF THE INVENTION

The invention in general relates to ignitors, and more particularly to a non-electric ignitor for causing the ignition of flammable materials.

Flammable solids are initiated by an ignitor assembly. Many of these ignitor assemblies utilize explosive materials in conjunction with an electric ignition arrangement. These types of assemblies often present a dangerous situation in that they are susceptible to spurious RF electromagnetic radiation and may prematurely initiate. In addition, many of these devices represent an environmental hazard. Explosive materials used for initiation commonly contain heavy or toxic metals. The present invention obviates these undesirable features by providing an ignitor design which is non-electrically initiated and which contains no Class 1 explosive materials.

SUMMARY OF THE INVENTION

The improved ignitor apparatus of the present invention includes an elongated container having a charge of a flammable solid, such as thermite, deposited in one end of the container. A shock tube is inserted into the other end of the container and is operable, when initiated to deliver a shock wave into the container, which causes ignition of the thermite. Filler material is disposed about the tube within the container and is axially spaced from the thermite charge.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

Figure 1:
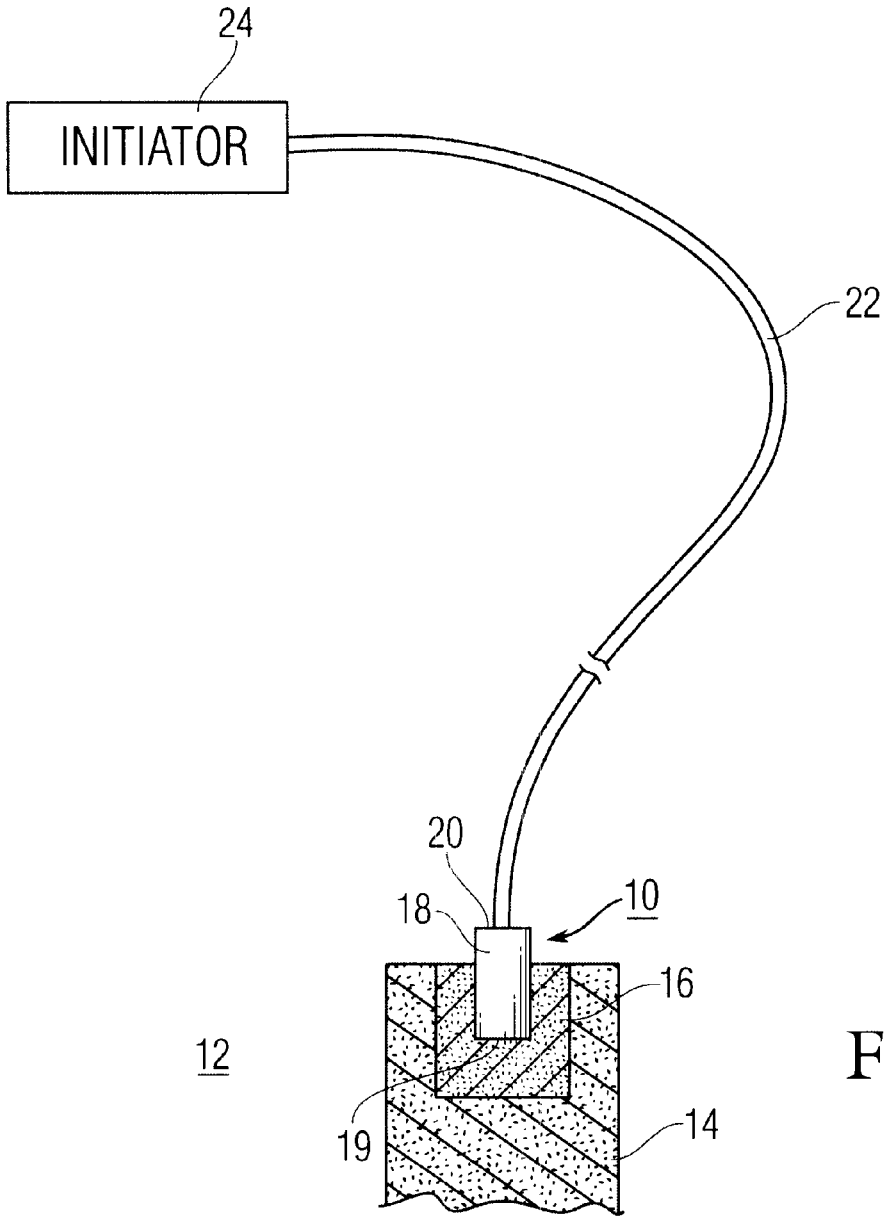
FIG. 1 illustrates a typical use for the invention.

In the drawings, which are not necessarily to scale, like or corresponding parts are denoted by like or corresponding reference numerals.

In FIG. 1 an ignitor apparatus 10 is seen inserted into an incendiary device 12, by way of example, and having a main charge assembly 14 set off by reactive material 16. The reactive material 16 is a flammable solid which in one embodiment is a powdered mixture of iron oxide and aluminum, commonly known as thermite. The ignitor 10, which will be inserted into the incendiary device 12, includes an elongated cylindrical container 18, having a closed, first end 19 and an opposite, second end 20, into which is fitted a shock tube 22 initiated by a shock wave generated by initiator 24.

Shock tube 22 is a commercially available product which consists of a flexible polymer tubing with a dusting of explosive powder deposited on the inside diameter of the tube. The shock wave, by way of example, may be generated by an electrical arc or the rapid decomposition of energetic material such as contained in a shotgun primer. The shock wave is sustained throughout the length of the shock tube 22 by the reaction of the explosive powder deposited within the tube. The dusting of the explosive powder is just enough to generate a rapid, low energy reaction to sustain the shock wave, presenting minimal danger to a handler.

Figure 2:
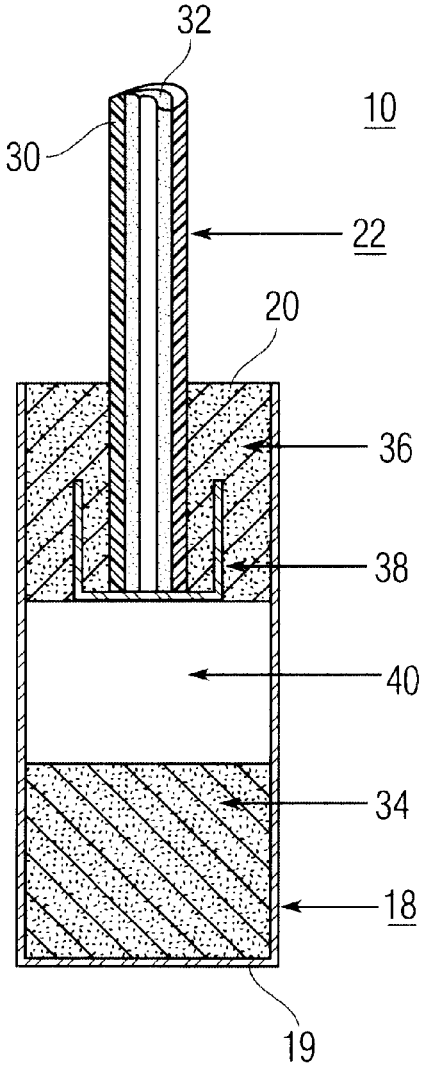
FIG. 2 is a cross-sectional view of one embodiment of the present invention.

In FIG. 2, illustrating one embodiment of the present invention, the shock tube 22 is seen to include the polymer tubing 30 with the explosive powder 32 on its inside diameter. The container 18 includes, at its lower portion near end 19, a charge of a flammable solid such as thermite 34. Shock tube 22 is inserted into the opposite end 20 of container 18 and is surrounded by a filler material 36, which may be an elastomeric compound, to maintain the tube 22 in position. At the lower end of tube 22 is a cup-like barrier member 38, which together with the filler material 36 is separated from the thermite 34 by space 40.

In operation, with the ignitor inserted into an incendiary device, or the like, the initiator 24 (FIG. 1) causes a shock wave in tube 22 which bursts through barrier 38 and causes ignition of thermite 34. When thermite 34 ignites, a chemical reaction occurs which is rapid and violent, with the release of an extremely large amount of heat energy, which produces temperatures in excess of two thousand degrees Kelvin. This is enough to burst through and/or melt the container 18, which typically may be of aluminum, and ignite the thermite in the incendiary device 12.

Figure 3:
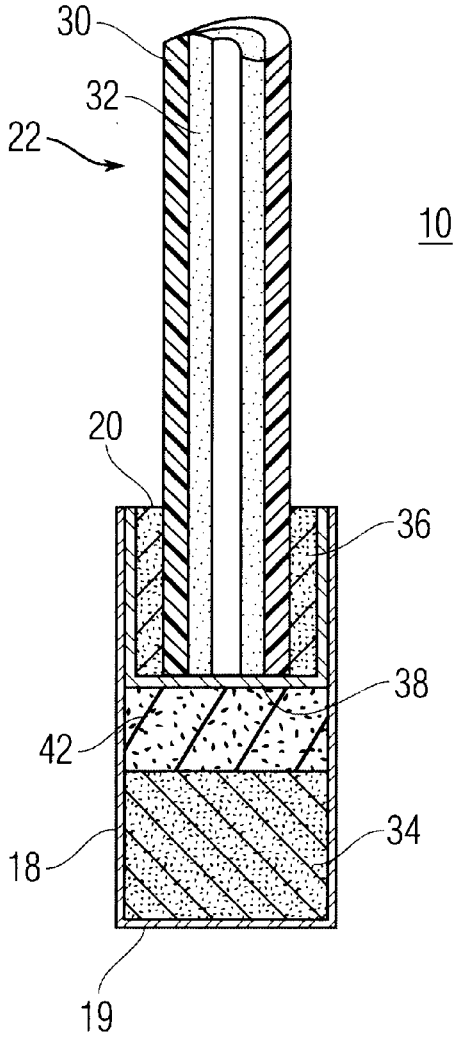
FIG. 3 in a across-sectional view of another embodiment of the present invention.

The embodiment illustrated in FIG. 3 is similar to that illustrated in FIG. 2, with the addition of a thermite section 42 interposed between the barrier 38 and thermite 34, located in the lower end of container 18. In the embodiment of FIG. 3, the container 18 is packed with a relatively dense charge of thermite 34, on top of which is the thermite charge 42 of lesser density.

Figure 4:
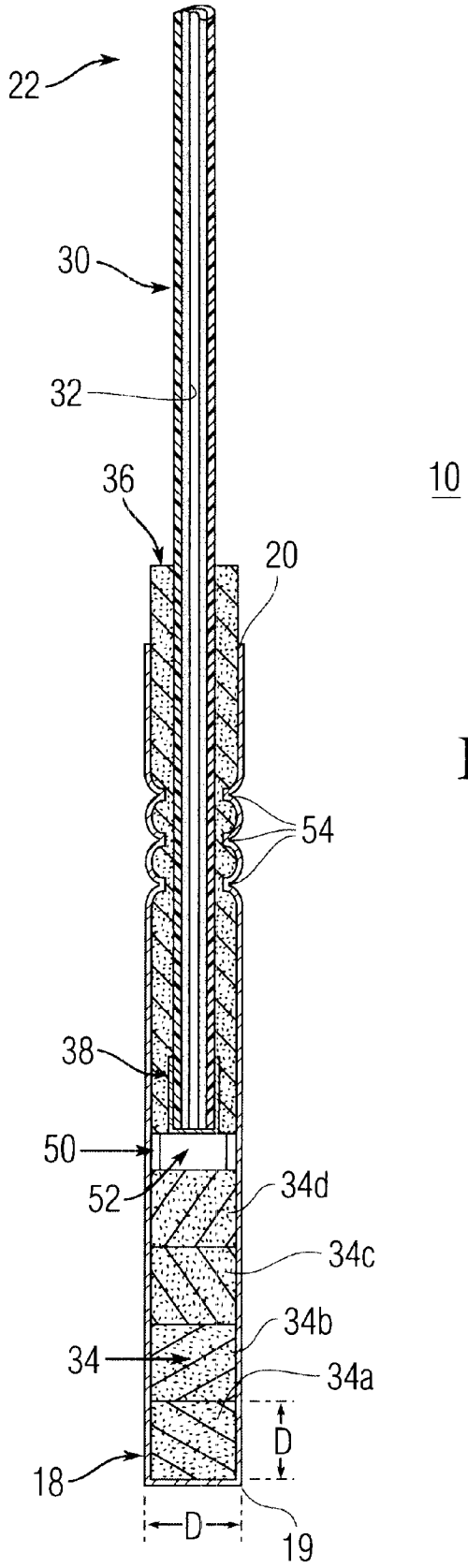
FIG. 4 is a cross-sectional view of another embodiment of the present invention.

FIG. 4 illustrates another embodiment of the invention in which the thermite charge 34 is deposited into the lower end 19 of container 18 in discrete sections, 34*a* to 34*d*. The axial length of each section 34*a* to 34*d* of thermite 34 is preferably, but not always, on the order of D, where D is the diameter of container 18. After a first section, 34*a*, is pressed into position, the next section 34*b* is inserted and so on until all of the sections (four shown by way of example) are loaded into the container 18. The ignitor 10 in FIG. 4 additionally includes a spacer member 50 in the form of a short hollow cylinder. Within this spacer member 50 is a charge of thermite 52, Which is of very low density, compared to the thermite 34.

When the shock tube 22 is initiated, the shock wave breaches barrier member 38, causing ignition of thermite 52, which, in turn, ignites the higher density thermite 34. In a preferred embodiment, the filler material 36 is comprised of an electrically conducting elastomeric material. With this arrangement, a ground path to container 18 is established for any potential electrical charges which may be on the shock tube 22, and which otherwise might cause the accidental ignition of the thermite within the ignitor 10. In order to ensure that the conductive elastomer 36 and shock tube 22 stay attached to the container 18, the container is provided with one or more crimps 54.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents. Having thus shown and described what is at present considered to be the preferred embodiments of the present invention, it should be noted that the same has been made by way of illustration and not limitation. Accordingly, all modifications, alterations and changes coming within the spirit and scope of the present invention are herein meant to be included.

What is claimed is:

1. An ignitor apparatus, comprising:

an elongated container having first and second ends;

a charge of thermite, comprising a plurality of axially arranged contiguous sections, deposited within said first end of said container;

a shock tube inserted into said second end of said container and operable, when initiated, to transmit a shock wave into said container that ignites said thermite; and, a filler material disposed around said shock tube within said container wherein said filler material is axially spaced from said thermite.

2. The apparatus according to claim 1 wherein said container has a diameter D and wherein the axial length of each said section is D.

3. The apparatus according to claim 1 wherein said filler material is an elastomer.

4. The apparatus according to claim 3 wherein said elastomer is electrically conducting.

5. The apparatus according to claim 1 wherein said container is crimped around said filler material.

6. The apparatus according to claim 1 further comprising a spacer member between said filler material and said flammable solid.

7. The apparatus according to claim 1 further comprising a barrier member disposed at the end of said shock tube within said container.

8. The apparatus of claim 7, further comprising an empty space extending from a first wall across said container to a second wall between said barrier member and said thermite.

9. The apparatus according to claim 8 further comprising a flammable solid disposed within said cylinder and having a density less than the density of said flammable solid deposited in said first end.

10. An ignitor apparatus, comprising:

an elongated container having first and second ends;

a charge of flammable solid, consisting of thermite, deposited within said first end of said container;

a shock tube inserted into said second end of said container and operable, when initiated, to transmit a shock wave into said container that ignites said thermite; and, a filler material disposed around said shock tube within said container wherein said filler material is axially spaced from said thermite.

11. The ignitor apparatus of claim 10, wherein said thermite is comprised of a plurality of axially arranged contiguous sections.

* * * * *